US007043432B2

(12) United States Patent
Bakis et al.

(10) Patent No.: US 7,043,432 B2
(45) Date of Patent: May 9, 2006

(54) METHOD AND SYSTEM FOR TEXT-TO-SPEECH CACHING

(75) Inventors: Raimo Bakis, Briarcliff Manor, NY (US); Hari Chittaluru, Boca Raton, FL (US); Edward A. Epstein, Putnum Valley, NY (US); Steven J. Friedland, Boca Raton, FL (US); Abraham Ittycheriah, Danbury, CT (US); Stephen G. Lawrence, Southhampton (GB); Michael A. Picheny, White Plains, NY (US); Charles Rutherfoord, Delray Beach, FL (US); Maria E. Smith, Plantation, FL (US)

(73) Assignee: International Business Machines Corporation, Armonk, NY (US)

( * ) Notice: Subject to any disclaimer, the term of this patent is extended or adjusted under 35 U.S.C. 154(b) by 790 days.

(21) Appl. No.: 09/941,301

(22) Filed: Aug. 29, 2001

(65) Prior Publication Data

US 2003/0046077 A1 Mar. 6, 2003

(51) Int. Cl.
*G10L 13/08* (2006.01)
*G10L 13/00* (2006.01)

(52) U.S. Cl. ..... 704/260; 704/258; 711/136

(58) Field of Classification Search ..... 704/260, 704/258, 261; 711/118, 130, 136
See application file for complete search history.

(56) References Cited

U.S. PATENT DOCUMENTS

| | | | | |
|---|---|---|---|---|
| 3,704,345 | A * | 11/1972 | Coker et al. | 704/266 |
| 5,500,919 | A * | 3/1996 | Luther | 704/260 |
| 5,819,220 | A * | 10/1998 | Sarukkai et al. | 704/270.1 |
| 5,845,248 | A * | 12/1998 | Nishida et al. | 704/260 |
| 5,924,068 | A * | 7/1999 | Richard et al. | 704/260 |
| 6,141,642 | A * | 10/2000 | Oh | 704/260 |
| 6,324,511 | B1 * | 11/2001 | Kiraly et al. | 704/260 |
| 6,600,814 | B1 * | 7/2003 | Carter et al. | 379/88.16 |
| 6,678,659 | B1 * | 1/2004 | Van Kommer | 704/260 |
| 2001/0048736 | A1 * | 12/2001 | Walker et al. | 379/88.23 |
| 2002/0091524 | A1 * | 7/2002 | Guedalia | 704/260 |

* cited by examiner

*Primary Examiner*—W. R. Young
*Assistant Examiner*—James S. Wozniak
(74) *Attorney, Agent, or Firm*—Akerman Senterfitt

(57) ABSTRACT

In a text-to-speech system, a method of converting text-to-speech can include receiving a text input and comparing the received text input to at least one entry in a text-to-speech cache memory. Each entry in the text-to-speech cache memory can specify a corresponding spoken output. If the text input matches one of the entries in the text-to-speech cache memory, the cached speech output specified by the matching entry can be provided.

29 Claims, 3 Drawing Sheets

METHOD AND SYSTEM FOR TEXT-TO-SPEECH CACHING

BACKGROUND OF THE INVENTION

1. Technical Field

This invention relates generally to converting text-to-speech, and more particularly, to improving the efficiency of text-to-speech systems.

2. Description of the Related Art

A text-to-speech (TTS) system can convert input text into an output acoustic signal imitating natural speech. More specifically, TTS systems can receive a text input and convert the input text to an acoustic waveform recognizable as speech corresponding to the input text. Some conventional TTS systems can operate on a pure text input and produce a corresponding speech output with little or no preprocessing or analysis of the received text. Other more complex TTS systems can process received text inputs to determine various semantic and/or syntactic attributes of the text which can influence the pronunciation of the text. Still other TTS systems can receive annotated text inputs wherein the annotations specify pronunciation information used by the TTS to produce more fluent and human-like speech.

TTS systems can be used within a variety of interactive voice response systems. Though TTS systems are not limited to a particular use, TTS systems can be used in conjunction with particular application specific systems such as financial management or reservation management systems. In consequence, a TTS system may frequently generate speech relating to the particular subject addressed by the application specific system. Oftentimes, a TTS system will receive the same text input multiple times. Despite the particular method used by a TTS system to produce speech, conventional systems fully process each received text input to convert that text to a speech output. That is, such TTS systems fully process each received text input to construct a corresponding spoken output without regard for having previously converted the same text input to speech, and without regard for how often identical text inputs are received by the TTS system. Such redundant processing can be inefficient, consume processing resources, and waste time.

SUMMARY OF THE INVENTION

The invention disclosed herein provides a method and system for incorporating and using a text-to-speech (TTS) cache memory with a TTS system. The TTS cache memory can store received text inputs, corresponding spoken outputs, a variety of attributes, callback information, processed text including normalized text and/or parsed text, or any combination thereof within an entry. Received text inputs can be compared against the cached entries. If a match exists, the information within the entry can be used rather than constructing a spoken output in its entirety. The TTS system can manage the TTS cache entries using a scoring mechanism wherein the scores can be periodically updated.

One aspect of the present invention can include a method of converting text-to-speech including receiving a text input and comparing the received text input to at least one entry in a TTS cache memory. Each entry in the TTS cache memory can specify a corresponding spoken output. If the text input matches one of the entries in the TTS cache memory, the spoken output specified by the matching entry can be provided. The method further can include logging each match of the text input with a TTS cache entry.

If the text input does not match an entry in the TTS cache memory, the method can include determining a spoken output corresponding to the text input and storing an entry in the TTS cache memory corresponding to the text input. The entry can specify the determined spoken output. One of the entries in the TTS cache memory also can be removed. If each entry in the TTS cache memory has a score, the scores can be periodically updated. In that case, the method can include removing at least one of the entries in the TTS cache memory having a lower or a lowest score.

In another embodiment of the invention, the received text input further can include corresponding attributes. If so, the entries in the TTS cache memory also can include attributes. Accordingly, the comparing step can include comparing the attributes of the received text input with attributes of the entries in the TTS cache memory. Still, in another embodiment of the invention, the TTS cache entries can include the spoken outputs.

Another embodiment of the invention can include a method of converting text-to-speech using a TTS cache memory having a plurality of entries, wherein each entry can include a processed form of the text specifying a spoken output. The method can include receiving a text input and processing the text input to determine a form specifying a spoken output for the received text. The determined form can be compared with the entries in the TTS cache memory. If the processed text input matches one of the entries in the TTS cache memory, a spoken output specified by the matched entry can be provided. Regardless of the specific embodiment of the invention, the TTS cache can be shared across multiple TTS processes.

Another aspect of the invention can include a method of administering entries of a cache memory including adding a plurality of entries to a cache memory and assigning a score to each one of the plurality of entries. Each score can determine when a corresponding entry is deleted. Hits in the cache memory which occur between a previous score update and a subsequent score update can be logged and each score can be periodically updated. For example, each score can be multiplied by a predetermined multiplier, and a value representative of the logged hits for each one of the plurality of entries can be added. The logged hits can be cleared and at least one of the plurality of entries in the cache memory having a lower or a lowest score can be deleted.

Another aspect of the invention can include a TTS system including a TTS engine for receiving text and producing a spoken output representative of the received text. A TTS cache memory can be included for storing selected entries corresponding to received text inputs. The entries can specify spoken outputs corresponding to the selected received text inputs. In one embodiment, the entries can be programmed. In another embodiment of the invention, the TTS cache entries can include the spoken outputs. As mentioned, the TTS cache can be shared across multiple TTS processes.

BRIEF DESCRIPTION OF THE DRAWINGS

There are shown in the drawings embodiments which are presently preferred, it being understood, however, that the invention is not so limited to the precise arrangements and instrumentalities shown.

DETAILED DESCRIPTION OF THE INVENTION

The invention disclosed herein provides a method and system for incorporating and using a text-to-speech (TTS) cache memory with a TTS system. In particular, the TTS cache memory can store received text inputs, corresponding spoken outputs, a variety of attributes, callback information, processed text including normalized text and/or parsed text, or any combination thereof as an entry. As additional text inputs are received and the TTS system continues to operate, subsequent received text inputs can be compared against cached entries. Accordingly, if a received text input corresponds to a cached entry, the spoken output specified by the entry can be utilized rather than constructing the spoken output from the received text input. The TTS cache can utilize a scoring mechanism wherein the scores are continually and periodically updated. The scores can be used to determine which entries to delete.

Figure 1:
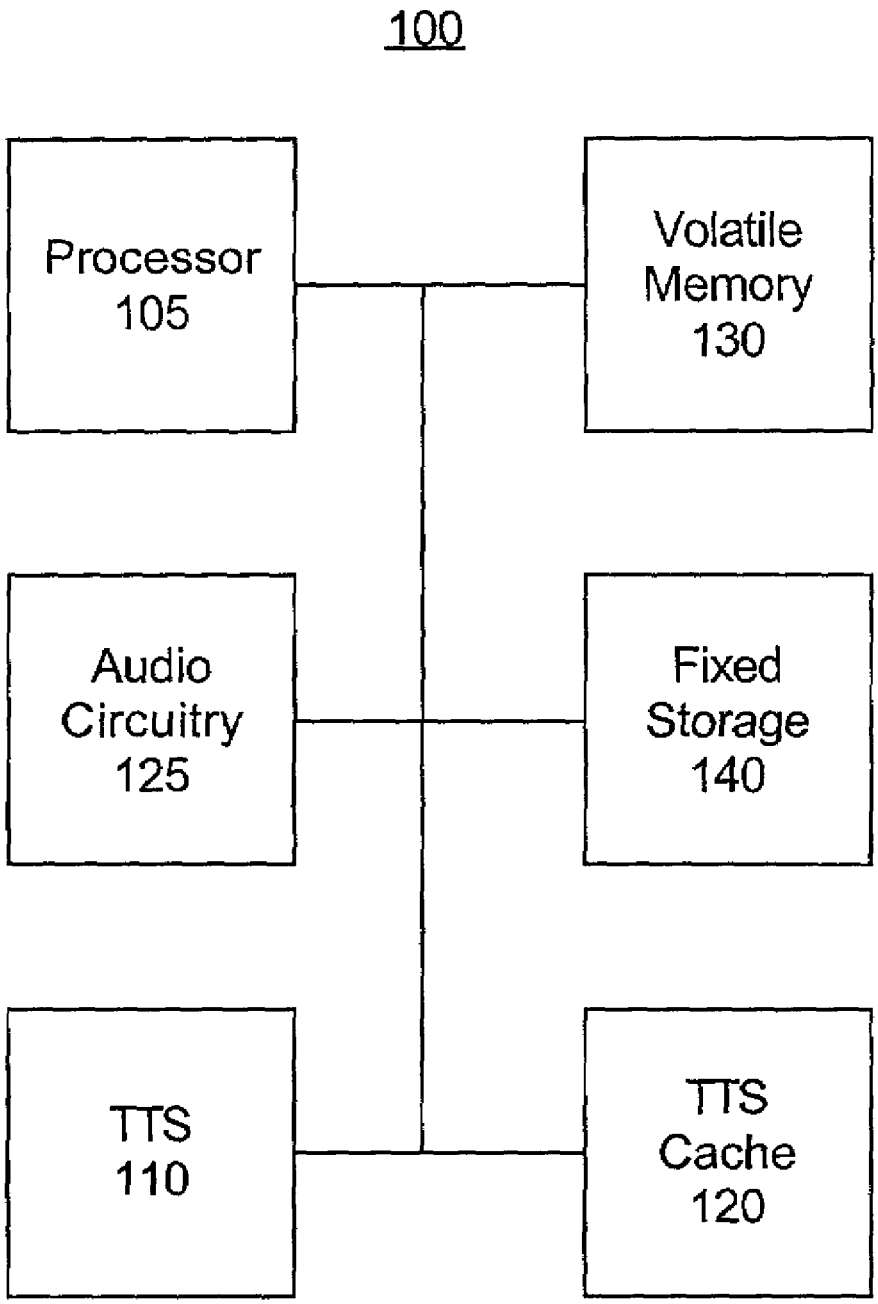
FIG. 1 is a schematic diagram illustrating an exemplary computer system for use with the inventive arrangements disclosed herein.

FIG. 1 is a schematic diagram illustrating an exemplary computer system for use with the inventive arrangements disclosed herein. As shown in FIG. 1, the computer system 100 can include a processor 105, a memory device 130 such as a RAM and/or ROM, a fixed storage 140 such as an optical or magnetic bulk data storage medium, and audio circuitry 125 for processing audio and performing analog-to-digital and digital-to-analog conversions. The aforementioned components can be connected through suitable interface circuitry such as a communications bus. The various hardware requirements for the computer system as described herein generally can be satisfied by any one of many commercially available high speed computers.

The computer system 100 further can include a TTS system 110 and a TTS cache 120. The TTS system 110, which can be included within memory 130 and/or loaded from memory 140, can include a TTS engine, also referred to as a TTS synthesis engine. The TTS system 110, as is well known in the art, can convert a text input to a spoken output. One embodiment of the present invention can include a TTS system 110 which performs little or no pre-processing of a received text input. Such systems can construct a spoken output for a received text input by correlating letters of the received text input to phonetic information within the TTS system. These TTS systems often construct spoken outputs with little or no context specific pronunciation guidelines.

Another embodiment of the invention can include a TTS system 110 capable of receiving attributes relating to the pronunciation of the text input. The attributes enable the TTS system 110 to customize the spoken outputs and/or produce more natural and human-like pronunciation of text inputs. The attributes can include, but are not limited to, semantic and syntactic information relating to a text input, the stress, pitch, gender, speed, and volume to be used when producing a spoken output, as well as the prosody of the text input. Other attributes can include information relating to the syllabic makeup or grammatical structure of a text input or the particular phonemes used to construct the spoken output.

TTS systems also can process received text using text processing algorithms and text parsing technologies. One type of processing can include normalizing the text. As is known in the art, normalization entails standardizing received text inputs. For example, although text inputs such as "2 oz.", "2 ounces", "two oz.", and "two ounces" are textually different, the pronunciations of the text inputs should be the same. Accordingly, such text inputs having identical pronunciations can be converted to a standard textual representation before converting the text to speech. Another form of processing can include parsing a received annotated text input and converting that input into another intermediate format which can specify a spoken output. Notably, TTS systems can normalize text, determine an intermediate format of the text input (generate processed text), or perform both for any given text input.

In addition to conventional memory devices such as random access electronic memories and bulk data storage mediums, the computer system 100 can include a TTS cache 120 operatively connected thereto. The TTS cache 120 can be a small, separate, higher speed memory system which can store previously used data from larger, slower memory systems. The TTS cache 120 can be composed of one larger cache or several smaller independent caches. Additionally, the TTS cache 120 can be implemented in main memory, for example memory 130, wherein a portion of the regular memory is partitioned off from the main memory for use as a cache.

The TTS cache 120 can store one or more entries. The information included within an entry can depend upon the specific type of TTS system used. For example, each TTS cache entry can include received text, which can include plain text or annotated text, a corresponding spoken output derived by the TTS system (audio output), attributes of received text, processed text, callback information, or any combination thereof. In general, the attributes can be used by the TTS system to customize and/or improve pronunciation of spoken outputs. Notably, in one embodiment of the invention, the audio spoken output need not be included within the TTS cache. Rather, to reduce the amount of storage necessary to implement the TTS cache, the entries can include intermediate data values which can be used to more efficiently re-generate the spoken output.

Figure 2:
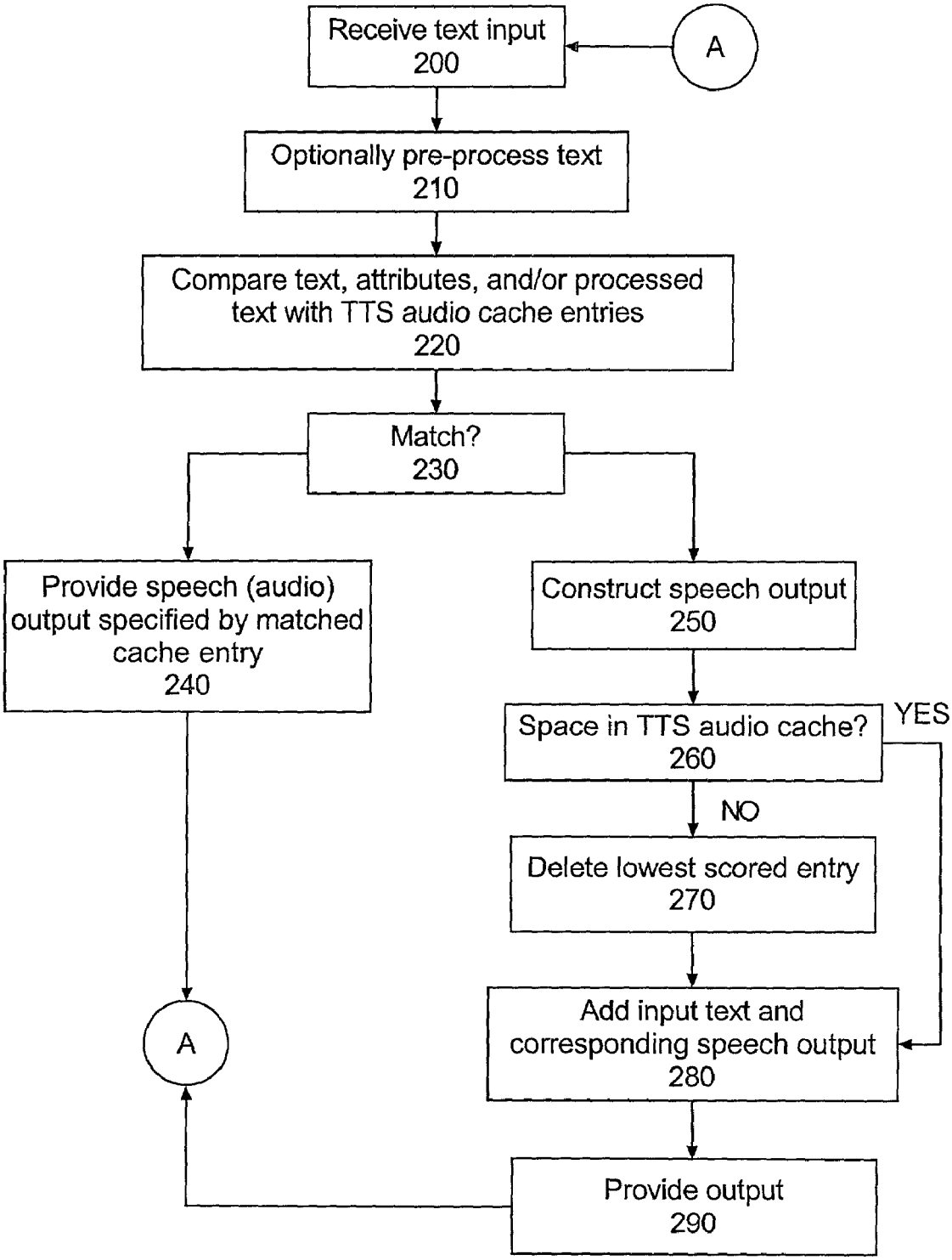
FIG. 2 is a flow chart illustrating an exemplary method of using a text-to-speech cache.

FIG. 2 is a flow chart illustrating an exemplary method of using a TTS cache. In accordance with the inventive arrangements, the method can begin with the TTS cache having no entries wherein new entries are added one by one as operation of the TTS system continues. Alternatively, the TTS cache can be persistent in that entries from a previous TTS session can be saved upon exit and reloaded at a later time. In any case, a text input can be received in step 200.

In step 210, the text input can be optionally processed. As mentioned, if the TTS system receives annotated text input, the TTS system can process the received text to determine a more suitable pronunciation of the received text. Also, the TTS system can normalize and parse the text as well as convert the text to an intermediate format useful for specifying a spoken output. In step 220, the received text can be compared to the entries within the TTS cache to determine whether a match exists. Notably, if the TTS system is capable of receiving attributes, and if such information is stored within the TTS cache, then in addition to comparing text, whether plain text or annotated text, the attributes of received text inputs can be compared to the attributes of the TTS cache entries. Still, processed text (intermediate format) specifying a spoken output can be compared to entries if the entries include such information. In step 230, a determination can be made as to whether a match for the received text input was located within the TTS cache. If so, the method can continue to step 240. If not, the method can continue to step 250.

In step 240, when a match exists within the TTS cache, the TTS system can retrieve the spoken output specified by the matched entry. Accordingly, rather than continuing to process the received text input to construct a spoken output, the spoken output specified by the matched TTS cache entry can be provided as an output. As mentioned, the spoken output can be provided from the TTS cache if such information is stored in the TTS cache. If not, however, the spoken output can be specified by the entry and stored outside of the TTS cache. Regardless of where the spoken output is stored, the spoken output can be provided. Further, those skilled in the art will recognize that the spoken output corresponding to a TTS cache entry can include callback information. Callback information can include any information passed to the application specific program by the TTS system for coordination of the two systems. For example, a TTS system can provide a "front-end" program or other application specific program with timing information such as which word of a given output phrase is being spoken by the TTS system at any given time. Using this information, an application specific program can coordinate operation with the TTS system. For example, the application program can display the spoken text and highlight that text as each word is spoken by the TTS system. Accordingly, when an entry is matched, that callback information can be retrieved from the TTS cache and provided to the application specific program in an appropriate fashion. After step 240, the method can continue to jump circle A to begin anew.

In step 250, in the case where no match was located within the TTS cache, the TTS system can construct a spoken output for the received text input. After step 250, the method can continue to step 260 to determine whether the TTS cache has enough memory available for storing a new entry. If not, the lowest scoring entry can be deleted in step 270 before proceeding to step 280. If the TTS cache has enough memory available, the method can proceed directly to step 280.

In step 280, a new entry corresponding to the received text can be added to the TTS cache. For example, the entry can include, but is not limited to, received text, which can include plain text or annotated text, a corresponding spoken output derived by the TTS system (audio output), attributes of received text, processed text, callback information, or any combination thereof. After completion of step 280, the method can continue to step 290.

In step 290, the spoken output constructed by the TTS system can be provided. For example, the constructed spoken output can be provided to the application specific program. Any necessary callbacks also can be determined and provided. After step 290, the method can repeat as necessary.

Figure 3:
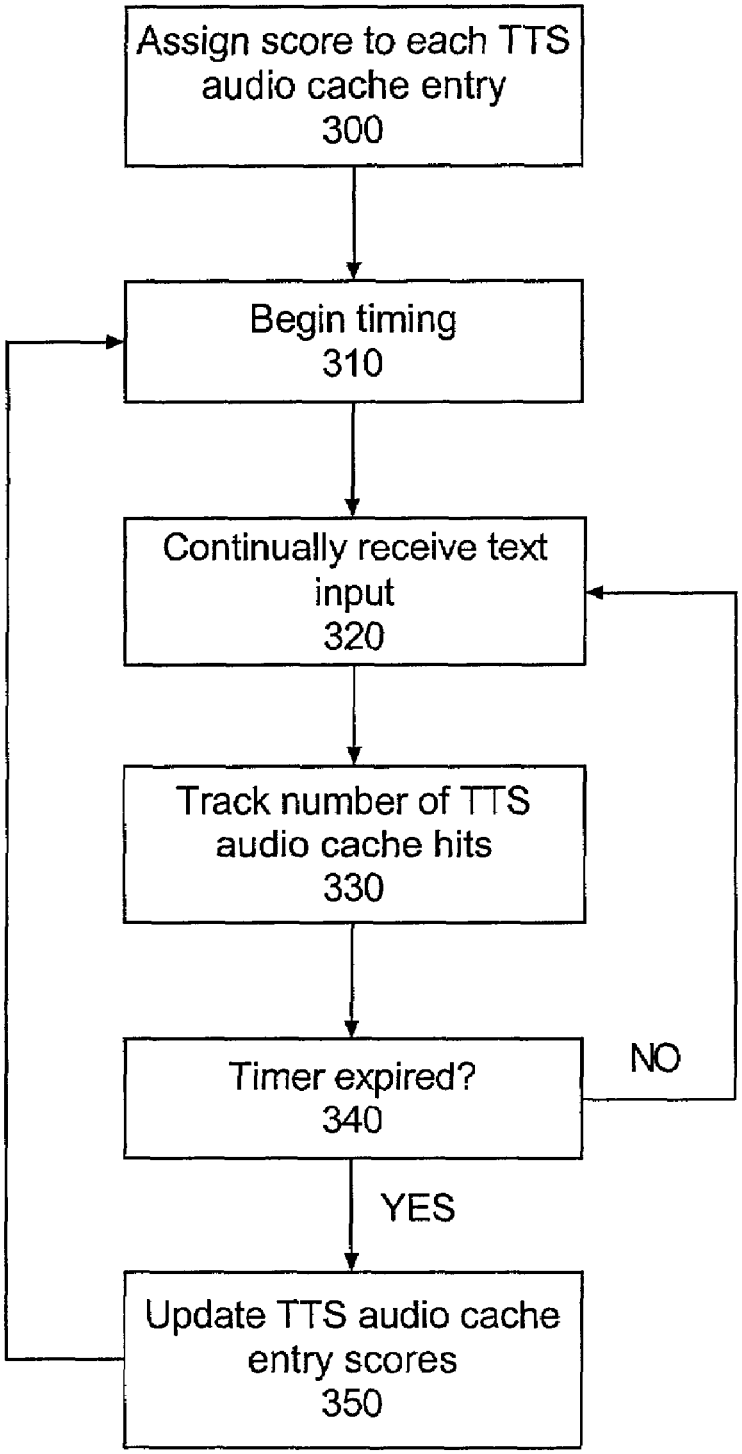
FIG. 3 is a flow chart illustrating an exemplary method of managing entries within a text-to-speech cache.

FIG. 3 is a flow chart illustrating an exemplary method of managing entries within a TTS cache. In general, the invention can selectively add and delete entries to the TTS cache based upon factors including, but not limited to, the frequency of use of an entry and the amount of time since an entry was last used. The TTS cache further can be configured to include selected context specific entries based upon the particular application or subject for which the TTS system is being used. For example, the TTS cache can include a limited number of predetermined entries which always remain within the memory.

In one embodiment of the TTS cache, entries can be removed based upon a score reflecting the usage of each entry. In particular, each entry can be assigned a score which can be updated periodically. For example, the scores can be updated at predetermined time intervals, or when an input is received, or when an entry is added to the TTS cache. Accordingly, whenever an entry must be deleted to accommodate a new entry, the entry having the lowest score can be removed to make room for the new entry.

The method can begin in step 300 wherein the TTS system can be initialized. For example, the TTS cache can be loaded with entries from a previous TTS session, with predetermined entries, or if the cache has been cleared, entries can be added one by one as the TTS operates. In any case, each entry can be assigned a score by default, by recalling a score that was stored from a previous TTS session, or by using a scoring algorithm. After completion of step 300, the method can continue to step 310.

In step 310, a timing mechanism can be enabled. The timing mechanism can be configured with a predetermined amount of time. For example, the timing mechanism can be configured to time out every 10 seconds. Notably, the particular amount of time can be determined through an empirical analysis of the performance of the TTS cache in addition to considering the particular application in which the TTS system is being used. After beginning the timer, the method can continue to step 320.

In step 320, the TTS system can continually receive text inputs for processing. As those text inputs are received, in step 330, the number of TTS cache hits can be recorded for each entry. That is, each time a received text input matches a TTS cache entry, whether the actual text, processed text, the attributes relating to the text, or any combination thereof are matched, a hit can be recorded for the matched entry.

Proceeding to step 340, the method can continually monitor for the expiration of the timer or the passage of the predetermined amount of time. If the timer has not expired, the method can loop back to step 320 to continually receive text inputs, process the text inputs, and track the TTS cache hits. Once the timer has expired, however, the method can continue to step 350.

In step 350, the TTS system can update the score of each entry within the TTS cache. The score can correspond to the number of times an entry in the TTS cache is hit, for example a count. Alternatively, as mentioned, the score can reflect the usage frequency of each entry and the elapsed time since the last recorded hit corresponding to the entry. Though the scores can be based upon any of a variety of algorithms, in one embodiment of the invention, the score can be calculated using the following algorithm: NEW SCORE=A*(OLD SCORE)+N. Within the algorithm, "A" can be a constant between 0 and 1 which can be chosen on the basis of actual system tests. "N" can be the number of times an entry has been re-used, or the number of hits for an entry, since the last update of the scores.

Accordingly, if the value of "A" is less than 1, an entry's score will continually decrease over time if no hits are registered for the particular entry. If hits were recorded between the last score update and the current score update for the entry, although the score is adjusted by the factor "A", the score also is increased by "N". If the value of "A" is set to 1, the score corresponds to a least frequently used algorithm wherein the score reflects the number of times an entry has been used. If the value of "A" is very small, however, the score corresponds to a least recently used algorithm where recent hits can significantly affect a score. For intermediate values of "A", the algorithm becomes a combination of the least frequently used and the least recently used. Regardless, the entry having the lowest score can be deleted from the TTS cache to accommodate new entries if space in the cache is needed. Notably, each new entry within the TTS cache can be assigned a default value, for example 1. After completion of step 350, the method can continue to step 310 to begin another timing cycle.

Other embodiments of the present invention can include updating the TTS cache entry scores periodically responsive to particular events. As mentioned, the scores can be updated when a text input is received or when an entry is made to the cache. In such cases, the amount of time since the scores were last updated can be calculated. Based on the amount of elapsed time, the scoring algorithm can be applied to each score one or more times as if the scoring algorithm had been applied to each score at predetermined intervals. For example, if the predetermined interval is 10 seconds and an input has been received 31 seconds after the most recent score update, the scoring algorithm can be applied to each score 3 times. Notably, the number of hits can be logged with a timing indicator such that the algorithm can be applied to each score accurately.

Although the embodiments disclosed herein for managing cache entries can be particularly suited for use with a TTS cache within a TTS system, those skilled in the art will recognize that the aforementioned embodiments can be used in conjunction with caching systems in general. Accordingly, the invention is not so limited to use within a TTS system.

The present invention can be realized in hardware, software, or a combination of hardware and software. The present invention can be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein. The present invention also can be embedded in a computer program product, which comprises all the features enabling the implementation of the methods described herein, and which when loaded in a computer system is able to carry out these methods.

Computer program in the present context means any expression, in any language, code, or notation, of a set of instructions intended to cause a system having an information processing capability to perform a particular function either directly or after either or both of the following: a) conversion to another language, code, or notation; b) reproduction in a different material form.

This invention can be embodied in other forms without departing from the spirit or essential attributes thereof. Accordingly, reference should be made to the following claims, rather than to the foregoing specification, as indicating the scope of the invention.

What is claimed is:

1. In a text-to-speech system, a method of converting text-to-speech comprising:

receiving a text input and a plurality of attributes associated with said text input, wherein said attributes specify stress, gender, grammar, speed, and volume for an audio rendering of said text input;

generating processed input by parsing and normalizing said text input;

comparing said processed input to at least one entry in a text-to-speech cache memory, wherein said entry in said text-to-speech cache memory specifies a corresponding spoken output, wherein said text-to-speech cache memory contains a plurality of entries that specify spoken outputs, attributes for rendering spoken output, and callback information, and wherein each spoken output has an assigned score;

if said processed input matches one of said entries in said text-to-speech cache memory, providing said spoken output specified by said matching entry and rendering said spoken output according to said plurality of attributes associated with said text input;

if said processed input fails to match one of said entries, generating an additional spoken output with a text-to-speech engine, generating an entry that specifies said additional spoken output, assigning a score to said additional spoken output, storing said additional spoken output and assigned score in said cache memory, and rendering said spoken output with the text-to-speech engine according to said plurality of attributes associated with said text input, wherein each assigned score is an updatable score computed by multiplying a previous score times a constant between zero and one and adding a number equal to the number of times a corresponding entry has been accessed since a last updating of the score;

if the cache memory is full when said additional spoken output is generated, deleting from said cache memory a spoken output having a lower score; and generating a display of said text input wherein each word of said display is successively highlighted in coordination with an audible rendering of a word of corresponding spoken output, coordination of said display and spoken output being based on call information stored in said cache memory.

2. The method of claim 1, wherein said text-to-speech cache entries include an intermediate output which is not a digitally encoded audio file; and wherein said text-to-speech engine converts said intermediate output to said spoken output.

3. The method of claim 1, wherein said text-to-speech cache is shared across multiple text-to-speech processes, wherein said text-to-speech processes are performed by a plurality of different text-to-speech engines, each engine utilizing said text-to-speech cache.

4. The method of claim 1, further comprising logging each said match of said text input with a text-to-speech cache entry.

5. The method of claim 1, further comprising periodically updating each said score.

6. The method of claim 1, further comprising comparing said attributes of said received text input with attributes of said entries in said text-to-speech cache memory.

7. A method of converting text-to-speech using a text-to-speech cache memory having a plurality of entries, wherein said entries comprise a processed form specifying a spoken output, wherein said processed form specifying spoken output does not comprise a digitally encoded audio file, said method comprising:

receiving a text input and a plurality of attributes associated with said text input, wherein said attributes specify stress, gender, grammar, speed, and volume for an audio rendering of said text input;

processing said text input to determine a form specifying a spoken output for said received text;

comparing said determined form of said text input with said entries in said text-to-speech cache memory;

assigning a score to each of said entries, wherein each score is an undatable score computed by multiplying a previous score times a constant between zero and one and adding a number equal to the number of times a corresponding entry has been accessed since a last updating of the score;

if said text input matches one of said entries in said text-to-speech cache memory, providing said processed form specified by said matching entry to a text-to-speech engine;

said text-to-speech engine converting said processed form to said spoken output and rendering said spoken output according to said plurality of attributes associated with said text input; and generating a display of said text input wherein each word of said display is successively highlighted in coordination with an audible rendering of a word of said spoken output, coordination of said display and spoken output being based on call information stored in said cache memory.

8. The method of claim 7, wherein the determined form of said text input comprises at least one of normalized text that represents a standardized version of the text input and an intermediate format used by the text-to-speech engine.

9. The method of claim 7, wherein said text-to-speech cache is shared across multiple text-to-speech processes, wherein said text-to-speech processes are performed by a plurality of different text-to-speech engines, each engine utilizing said text-to-speech cache.

10. The method of claim 7, further comprising logging each said match of said text input with a text-to-speech cache entry.

11. A method of converting text-to-speech comprising:

storing a plurality of entries in a text-to-speech cache memory, wherein the text-to-speech cache memory is directly and locally coupled to at least one text-to-speech engine, wherein each said entry comprises a processed form specifying a spoken output, and wherein said text-to-speech cache memory contains a plurality of entries that specify spoken outputs, attributes for rendering spoken output, and callback information;

assigning a score to each one of said plurality of entries;

receiving a text input;

processing said text input to determine a form specifying a spoken output for said received text;

comparing said determined form of said text input with said entries in said text-to-speech cache memory;

when at least one of the plurality of entries in said text-to-speech cache memory is matched to said determined form, retrieving the processed form for the matching entry from the text-to-speech cache memory, and using the processed form to generate said spoken output based on said attributes;

when at least one of the plurality of entries in said text-to-speech cache memory is not matched to said determined form, using the at least one text-to-speech engine to generate said spoken output;

logging when one of said plurality of entries in said text-to-speech cache memory is matched to said received text input generating a display of said text input wherein each word of said display is successively highlighted in coordination with an audible rendering of a word of said spoken output, coordination of said display and spoken output being based on call information stored in said cache memory; and periodically updating said score for each one of said plurality of entries of said text-to-speech cache memory, wherein an updated score is computed by multiplying a previous score times a constant between zero and one and adding a number equal to the number of times a corresponding entry has been accessed since a last updating of the score.

12. A text-to-speech system comprising:

a text-to-speech engine for receiving text inputs and a plurality of attributes associated with said text and for producing a spoken output representative of said received text, wherein said attributes specify stress, gender, grammar, speed, and volume for an audio rendering of said text input; and a text-to-speech cache memory for storing selected entries corresponding to received text inputs and a score assigned to each entry wherein said entries specify spoken outputs corresponding to said selected received text inputs, wherein at least one processing interaction occurs between the speech-to-text engine and the text-to-speech cache memory when the text-to-speech engine uses the text-to-speech memory cache to generate the spoken output responsive to receiving text, said processing interactions comprising at least one interaction selected from the group consisting of a pre-processing interaction where the received text is processed into an intermediate form before being compared to entries of the text-to-speech cache that are stored in said intermediate form and a post-matching interaction where the specified spoken outputs retrieved from the text-to-speech cache memory are processed by the text-to-speech engine to generate the spoken output according to the associated attributes, and wherein each score is an undatable score computed by multiplying a previous score times a constant between zero and one and adding a number equal to the number of times a corresponding entry has been accessed since a last updating of the score.

13. The text-to-speech system of claim 12, wherein said text-to-speech cache entries include said spoken output, and wherein the processing interaction is a pre-processing interaction, and wherein the intermediate form comprises normalized text that represents a standardized version of the text input.

14. The text-to-speech system of claim 12, wherein said text-to-speech cache is shared across multiple text-to-speech processes, wherein said text-to-speech processes are performed by a plurality of different text-to-speech engines, each engine utilizing said text-to-speech cache.

15. A machine-readable storage, having stored thereon a computer program having a plurality of code sections executable by a machine for causing the machine to perform the steps of:

receiving a text input and a plurality of attributes associated with said text input, wherein said attributes specify stress, gender, grammar, speed, and volume for an audio rendering of said text input;

generating processed input by parsing and normalizing said text input;

comparing said processed input to at least one entry in a text-to-speech cache memory, wherein said entry in said text-to-speech cache memory specifies a corresponding spoken output, wherein said text-to-speech cache memory contains a plurality of entries that specify spoken outputs, attributes for rendering spoken output, and a score corresponding to each entry, wherein each spoken output has an ordinal ranking and wherein each score is an updatable score computed by multiplying a previous score times a constant between zero and one and adding a number equal to the number of times a corresponding entry has been accessed since a last updating of the score;

if said processed input matches one of said entries in said text-to-speech cache memory, providing said spoken output specified by said matching entry and rendering said spoken output according to said plurality of attributes associated with said text input;

if said processed input fails to match one of said entries, generating an additional spoken output with a text-to-speech engine, generating an entry that specifies said additional spoken output, assigning an ordinal ranking to said additional spoken output, storing said additional spoken output and assigned ordinal ranking in said cache memory, and rendering said spoken output with the text-to-speech engine according to said plurality of attributes associated with said text input;

if the cache memory is full when said additional spoken output is generated, deleting from said cache memory a spoken output having a lower ordinal ranking; and generating a display of said text input wherein each word of said display is successively highlighted in coordination with an audible rendering of a word of corresponding spoken output, coordination of said display and spoken output being based on call information stored in said cache memory.

16. The machine-readable storage of claim 15, wherein said text-to-speech cache entries include an intermediate output which is not a digitally encoded audio file; and wherein said text-to-speech engine converts said intermediate output to said spoken output.

17. The machine-readable storage of claim 15, wherein said text-to-speech cache is shared across multiple text-to-speech processes, wherein said text-to-speech processes are performed by a plurality of different text-to-speech engines, each engine utilizing said text-to-speech cache.

18. The machine-readable storage of claim 15, further comprising logging each said match of said text input with a text-to-speech cache entry.

19. The machine-readable storage of claim 15, further comprising removing one of said entries in said text-to-speech cache memory.

20. The machine-readable storage of claim 15, wherein each said entry in said text-to-speech cache memory has a score, said machine-readable storage further comprising periodically updating each said score.

21. A machine-readable storage, having stored thereon a computer program having a plurality of code sections executable by a machine for causing the machine to perform the steps of:

storing a plurality of entries in a text-to-speech cache memory, wherein each one of said entries comprises a processed form specifying a spoken output wherein said processed form specifying spoken output does not comprise a digitally encoded audio file;

assigning a score to each one of said plurality of entries, each score being an updatable score computed by multiplying a previous score times a constant between zero and one and adding a number equal to the number of times a corresponding entry has been accessed since a last updating of the score:

receiving a text input and a plurality of attributes associated with said text input, wherein said attributes specify stress, gender, grammar, speed, and volume for an audio rendering of said text input;

processing said text input to determine a form specifying a spoken output for said received text;

comparing said determined form of said text input with said entries in said text-to-speech cache memory;

if said text input matches one of said entries in said text-to-speech cache memory, providing said processed form specified by said matching entry to a text-to-speech engine;

said text-to-speech engine converting said processed form to said spoken output and rendering said spoken output according to said plurality of attributes associated with said text input; and generating a display of said text input wherein each word of said display is successively highlighted in coordination with an audible rendering of a word of said spoken output, coordination of said display and spoken output being based on call information stored in said cache memory.

22. The machine-readable storage of claim 21, wherein the determined form of said text input comprises at least one of normalized text that represents a standardized version of the text input and an intermediate format used by the text-to-speech engine.

23. The machine-readable storage of claim 21, wherein said text-to-speech cache is shared across multiple text-to-speech processes, wherein said text-to-speech processes are performed by a plurality of different text-to-speech engines, each engine utilizing said text-to-speech cache.

24. The machine-readable storage of claim 21, further comprising logging each said match of said text input with a text-to-speech cache entry.

25. The machine-readable storage of claim 21, wherein said text input does not match an entry in said text-to-speech cache memory, said method further comprising:

determining a spoken output corresponding to said text input by using the text-to-speech engine to text-to-speech convert the text input; and storing an entry in said text-to-speech cache memory corresponding to said text input, wherein said entry specifies said determined spoken output.

26. The machine-readable storage of claim 21, further comprising removing one of said entries in said text-to-speech cache memory.

27. The machine-readable storage of claim 21, wherein each said entry in said text-to-speech cache memory has a score, said machine-readable storage further comprising periodically updating each said score.

28. The machine-readable storage of claim 27, further comprising removing one of said entries in said text-to-speech cache memory having a lowest score.

29. A machine-readable storage, having stored thereon a computer program having a plurality of code sections executable by a machine for causing the machine to perform the steps of:

storing a plurality of entries in a text-to-speech cache memory, wherein the text-to-speech cache memory is directly and locally coupled to at least one text-to-speech engine, wherein each said entry comprises a processed form specifying a spoken output, and wherein said text-to-speech cache memory contains a plurality of entries that specify spoken outputs, attributes for rendering spoken output, and callback information;

assigning a score to each one of said plurality of entries;

receiving a text input;

processing said text input to determine a form specifying a spoken output for said received text;

comparing said determined form of said text input with said entries in said text-to-speech cache memory;

when at least one of the plurality of entries in said text-to-speech cache memory is matched to said determined form, retrieving the processed form for the matching entry from the text-to-speech cache memory, and using the processed form to generate said spoken output based on said attributes;

when at least one of the plurality of entries in said text-to-speech cache memory is not matched to said determined form, using the at least one text-to-speech engine to generate said spoken output;

logging when one of said plurality of entries in said text-to-speech cache memory is matched to said received text input generating a display of said text input wherein each word of said display is successively highlighted in coordination with an audible rendering of a word of said spoken output, coordination of said display and spoken output being based on call information stored in said cache memory; and periodically updating said score for each one of said plurality of entries of said text-to-speech cache memory, wherein an updated score is computed by multiplying a previous score times a constant between zero and one and adding a number equal to the number of times a corresponding entry has been accessed since a last updating of the score.

* * * * *